United States Patent [19]

Fauerbach et al.

[11] Patent Number: 4,663,868

[45] Date of Patent: May 12, 1987

[54] SCOOP WHEEL HAVING OSCILLATING IMPACT CUTTERS

[75] Inventors: Rudolf Fauerbach, Hilden; Karl-Erich Partz, Duesseldorf, both of Fed. Rep. of Germany

[73] Assignee: Mannesmann AG, Duesseldorf, Fed. Rep. of Germany

[21] Appl. No.: 757,639

[22] Filed: Jul. 22, 1985

[30] Foreign Application Priority Data

Jul. 21, 1984 [DE] Fed. Rep. of Germany ..... 3427038

[51] Int. Cl.[4] ..... E02F 3/24

[52] U.S. Cl. ..... 37/190; 37/DIG. 18; 37/141 T; 299/14; 299/67

[58] Field of Search ..... 37/DIG. 18, 189, 190, 37/191 R, 141 T; 299/14, 89, 85, 69, 67

[56] References Cited

U.S. PATENT DOCUMENTS

| | | | |
|---|---|---|---|
| 901,008 | 10/1908 | Hurst | 37/191 R |
| 3,677,604 | 7/1972 | Leyrat | 37/DIG. 18 X |
| 3,746,100 | 7/1973 | Hall et al. | 37/DIG. 18 X |
| 4,012,856 | 3/1977 | Schwarz | 37/DIG. 18 X |
| 4,214,386 | 7/1980 | Franke | 37/DIG. 18 X |

FOREIGN PATENT DOCUMENTS

| | | | |
|---|---|---|---|
| 155628 | 6/1982 | Fed. Rep. of Germany | 37/190 |
| 1540070 | 2/1979 | United Kingdom | 37/DIG. 18 |
| 422819 | 9/1974 | U.S.S.R. | 37/189 |
| 687191 | 9/1979 | U.S.S.R. | 37/DIG. 18 |

*Primary Examiner*—Clifford D. Crowder
*Attorney, Agent, or Firm*—Ralf H. Siegemund

[57] ABSTRACT

A rotary wheel excavator having scoops with impact cutters only at the two front corners of the cutting edge of each scoop. Structure is provided for vibrating each impact cutter during a predetermined portion of the rotation of the wheel. The left and right hand impact cutters on each scoop are independently controlled, depending on the direction of swing of the excavator boom. The operation of the impact cutters is preferably under the control of a hydraulic system.

15 Claims, 13 Drawing Figures

SCOOP WHEEL HAVING OSCILLATING IMPACT CUTTERS

BACKGROUND OF THE INVENTION

The present invention relates to a scoop wheel for a power shovel, having several shovels or scoops for loosening, scraping and receiving material to be removed.

A scoop wheel of the type to which the invention pertains is for example shown in German printed patent 13 02 187. Herein it is suggested to increase the cutting force by tangentially imparting on the entire scoop wheel vibrational pulses. This procedure requires a rather large amount of energy in order to obtain the requisite vibrations of the scoop wheel and the scoops themselves. Moreover, the procedure is quite a noise one.

DESCRIPTION OF THE INVENTION

It is an object of the present invention to provide a new and improved scoop wheel for a power shovel so that the material to be loosened is removed with little energy and under as little noise development as possible.

In accordance with the preferred embodiment of the present invention, it is suggested to provide the individual scoops or shovels with impact blades oscillating in the direction of cutting. Hence only a small part of each scoop and only a very small part of the scoop wheel is set into vibration and the energy expenditure is low indeed. Also it was found, that very little additional noise is developed by this procedure.

In furtherance of the invention, it is suggested to support the scoop carrying wheel on a horizontally and vertically a moveable boom. The impact cutters or blades are arranged in the cutting edges of the scoop or they are arranged as precutters being disposed ahead of each scoop on the wheel. The cutting points of the impact cutter blades are oriented and positioned with respect to the material to be cut in the corners of the respective scoop because it was found that optimum material removal effect obtains in this fashion. As the boom carrying the scoop wheel is pivoted in the horizontal direction the impact cutter is particularly effective as far as corners of previously cut indents in the material to be removed is concerned. For further noise attenuation, scoops and precutters may be connected to the scoop wheel by means of attenuating elements.

In furtherance of the invention, the impact cutters may be provided with pins or shafts being slideably mounted in and received by sleeves provided on the scoops of the scoop wheel for this purpose; these sleeves actually pertain to cutter carriers for permitting axial displacement of the pins and, therefore, of the impact cutters. The pins themselves carry small pins sliding in grooves, of the sleeve to ensure that the cutter carrying pins do not rotate in the sleeves; moreover the sleeves may accommodate impact hammers, suitably energized to obtain the vibration of the impact cutter.

In order to establish further savings in energy, and also to avoid the generation of noise above ground, it is suggested to supplement the scoop wheel towards limiting the activation section of the impact cutters. These limiting features make sure that the impact cutters will be actuated for vibration only in that range of the wheel rotation when actually cutting. A limiting feature may in fact be realized by a flat portion of a generally round stator forming a chamber for a pressure medium and the rotor for the scoop wheel has bores and is mounted on the stator so that the chamber with the pressure medium will be feeding bores only when near the cutting range of the scoop wheel. Pressure medium conduits run from these bores to the impact hammers for fluid dynamic actuation..

The foregoing limiting features limits the actuation range for the generation of vibration peripherally. In many cases the material to be loosened will require lateral pivoting (about a vertical axis) so that only those impact blades which face in the direction of pivoting participate and have to be actuated. Therefore the pressure medium chamber should be divided into a left and right hand chamber and the rotor should have left and right hand bores accordingly; only one or the other of these chambers is actuated.

The aforementioned left-right limiter is preferably arranged in the rotational center of the scoop wheel and interposed as far as circuit is concerned between a pump for the pressure medium on one hand and the cylinders of the impact hammers on the other hand. Particularly valves should be interposed between the limiter and the cylinders. Each valve is connected to the respective cylinder of the impact hammer through a conduit and a control line, as well as with a buffer for the pressure medium, for compensating the pressure oscillations in the pressure medium system generally. A left/right control will be interposed between the pump governing the entire system and the aforementioned limiter system. The control device responds to the pivoting of the boom so that only the right hand or the left hand hammers and blades are activated.

Alternatively, to hydraulically operated impact cutter blades, one could use electrical, pneumatic or electro-pneumatical operation for the impact cutters. The electrical power for this can be provided through slip rings and brushes, the slip rings being situated on the shaft for the scoop wheel. The vibrators and vibrator energizers for the impact cutters may be provided through wedge like grooves and springs arranged respectively in the front faces between the blade carrying pins and the rotating impact hammers to thereby produce impacts on the shafts of the impact cutters as the impact hammer rotates.

Alternatively to the hydraulic control of the impact hammers one may use an electrical control.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings. FIG. 1 illustrates generally a plurality of shovels or scoops 2 mounted on a scoop wheel 1. In accordance with the specific example of FIG. 3, precutters 3 may be arranged in front of each of the scoops, but this is an optional feature. The precutters 3 and some of the scoops 2 are provided at their cutting corners with impact cutter blades 4, illustrated in greater detail in FIGS. 2 through 6. The material e.g. overburden loosened by means of the shovel scoops 2 is deposited upon a belt conveyor 30 as illustrated particularly in FIG. 2 which conveyor removes that material.

As shown specifically in FIG. 5 and 6, each shovel has two cutting corners, which can be arbitrarily labelled left and right corners. FIG. 2 shows also that the wheel 1 is arranged on a boom 5 and upon horizontal pivoting of that boom about a vertical axis and e.g. in direction of arrow b the respective right hand corners and impact hammers 4 are required to provide work for loosening material.

FIGS. 1 and 2 show particularly the work ranges and operating zones for the impact hammers 4. In the vertical section in FIG. 1 this operating and working range is determined by the angle a. In the horizontal cutting range as far as FIG. 2 is concerned, the working range is determined by the pivot motion to the left and to the right. Only those impact hammers 4 are activated which will in fact participate immediately and directly in the gaining and loosening of hard material.

Figure 2:
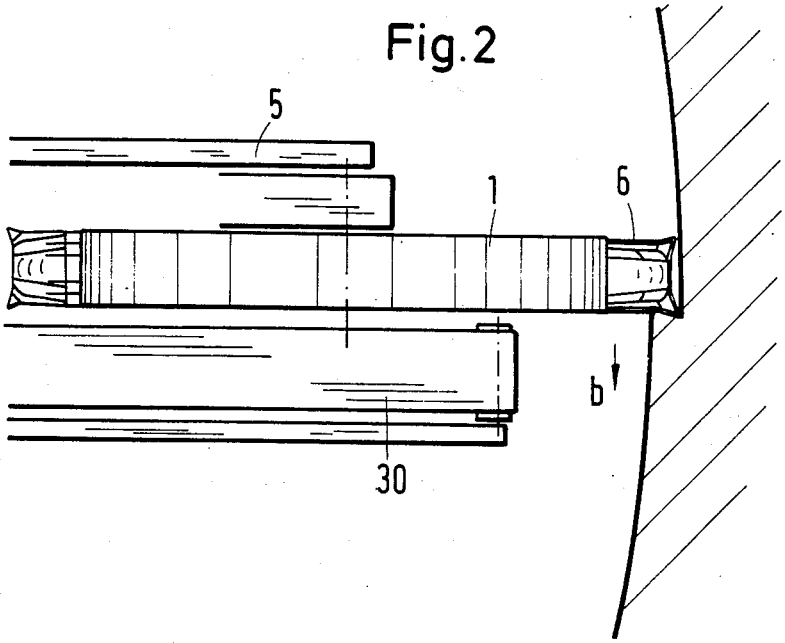
FIG. 2 is a top elevation of the arrangement shown in FIG. 1.
Figure 4:
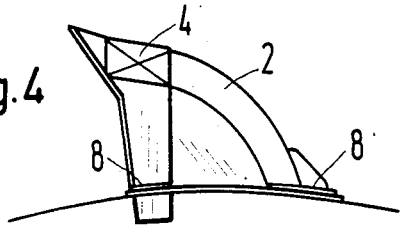
FIG. 4 illustrates a scoop and shovel to be used within the context of this invention and being shown on a larger scale than the preceding figure.
Figure 5:
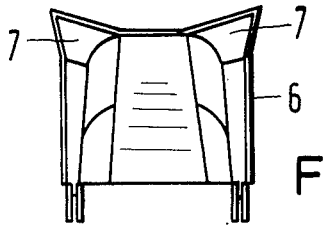
FIG. 5 is a front view of FIG. 4.
Figure 6:
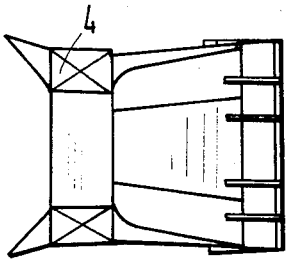
FIG. 6 is a top elevation of FIG. 4.

The cutter contour 6 is shown in FIGS. 2, 5 and 6 and the blade contour is configured so that the exertion of force by the blade upon the material to be cut is concentrated in the corner regions 7 of the shovel or scoop. The chosen cutting contour is effective by means of point like, large cutting forces, being made larger than cutting with the entire blade length; presently the cutting forces are concentrated at the point of engagement with the material to be loosened. These cutting forces will be considerably increased through the insertion of vibrating impact cutters 4.

For purposes of reducing noise, the scoops 2 and the precutters 3 are fastened to the scoop wheel through attenuating or damping elements 8 and cutter actuating hammers 12 are encapsulated.

Figure 7:
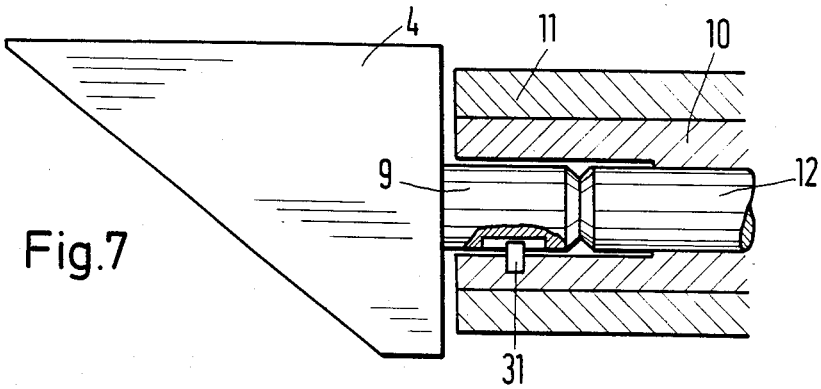
FIG. 7 is a longitudinal section view through the guide structure of an impact cutter and blade shown on an enlarged scale.

FIG. 7 illustrates an activatable impact cutter 4, as arranged in the cutting edge portion of either a scoop 2 or a precutter 3. The impact cutter blade 4 is provided with a shaft or pin 9 being protected by and received in a sleeve 10 to be integrated in a cutter carrier 11. The cutter activation results through the effective pressurization of an impact hammer 12. Pins 31 in FIG. 7 or 31*a* in FIG. 8 projecting inwardly from sleeves 10 into an axial groove 10*a* of pins 9 prevent the impact cutter blades 4 from rotating in the respective blade and cutter carrier 11.

Figure 8:
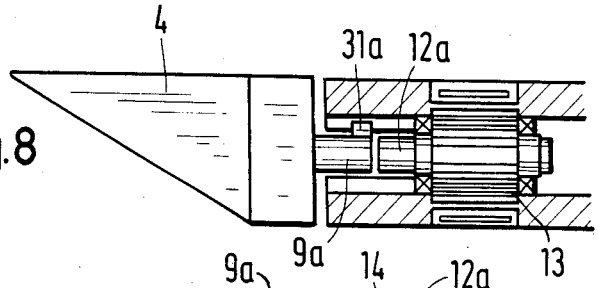
FIG. 8 is a similar longitudinal sectional view but through a modified impact cutter blade.
Figure 9:
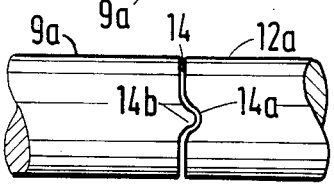
FIG. 9 illustrates a detail as indicated in FIG. 8 on an enlarged scale.
Figure 10:
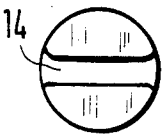
FIG. 10 is a front view of an impact hammer as shown in FIG. 9.

In the embodiment shown in FIGS. 8, 9 and 10, the shaft or pin 9*a* of the impact cutter blade 4 is activated through an impact hammer 12*a* being operated by means of an electro motor 13. A groove-and-spring arrangement 14 at the facing front faces of blade carrying pin 9*a* and hammer 12*a* produce oscillating movement of the 9*a* vis-a-vis the rotating hammer 12*a*, the groove 14*a* has a V-shaped opening and the spring 14*b* is constructed to have a pointlike projection jumping into and out of groove 14*a* as hammer 12*a* rotates. This way impact motion is produced by hammer 12*a* on pin 9*a*.

Figure 1:
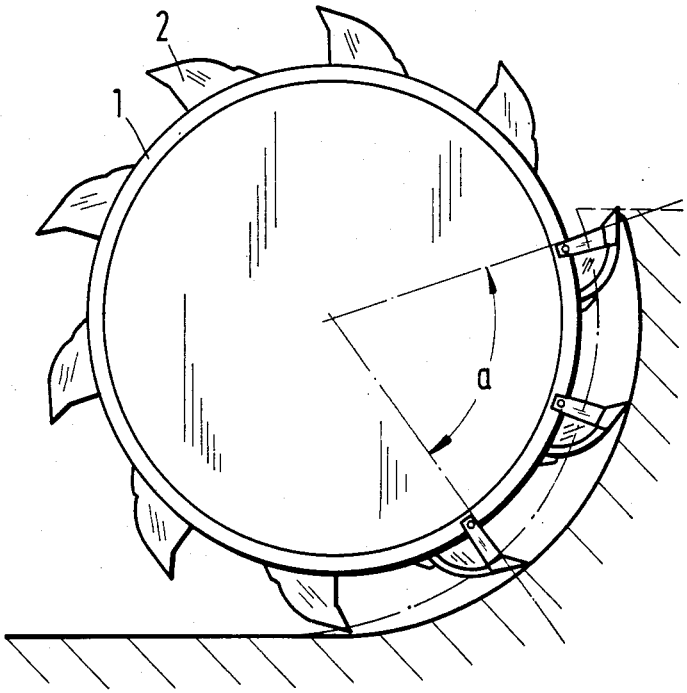
FIG. 1 is a general side view of a scoop wheel in action and improved in accordance with the present invention.
Figure 11:
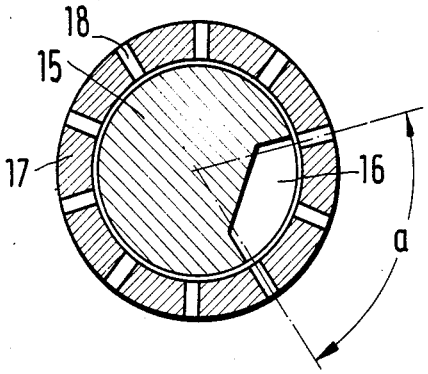
FIG. 11 is a section view showing the feeding of pressure medium to the actuators, showing particularly the peripherally effective limiting feature for impact cutter actuation.
Figure 12:
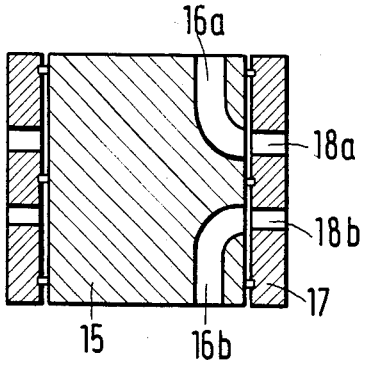
FIG. 12 is a longitudinal section as indicated in Fig. 11.

Turning back to the hydraulically operated version, FIGS. 11 and 12 illustrate a particular hydraulic passage way for through feeding or pressurized medium, from stationary parts of the equipment to rotating parts. A stator 15 is connected with the non-rotating axle of the scoop wheel 1 and receives pressure medium in the pressure medium chamber 16. A sleeve-like rotor 17 sits rotatably on the stator 15 and is provided with radial bores 18, each of which is in accordance with the circuit in FIG. 13 operatively connected with an impact cutter either of a scoop 2 or of a precutter 3. The chamber 16 of the pressure medium covers only the angle a corresponding to the work range of the vertical cutting arc as shown in FIG. 1. For then, and only then, can pressure medium pass through the bores 18 of the rotor 17.

The control of the impact hammers depends upon the horizontal pivot direction of the boom 5 during cutting operation. The pressure chamber 16 (FIG. 11) is actually divided into a right hand portion and a left hand portion, 16*a* and 16*b*. Analogously each bore 18 of FIG. 11 is to be understood to represent a pair of axially spaced bores 18*a* and 18*b*. The left/right control ultimately, i.e. the pivot direction dependency of such control, is obtained through the selection of bores 18*a* and 18*b* which are mechanically operable and closeable so that pressure medium will either enter the pressure chamber 16*a* and some of the bores 18*a* that may lead to left hand impact hammers 12 or pressure medium will flow through the pressure chamber 16*b* and some of the bores 18*b* to the right hand impact hammers 12.

Figure 13:
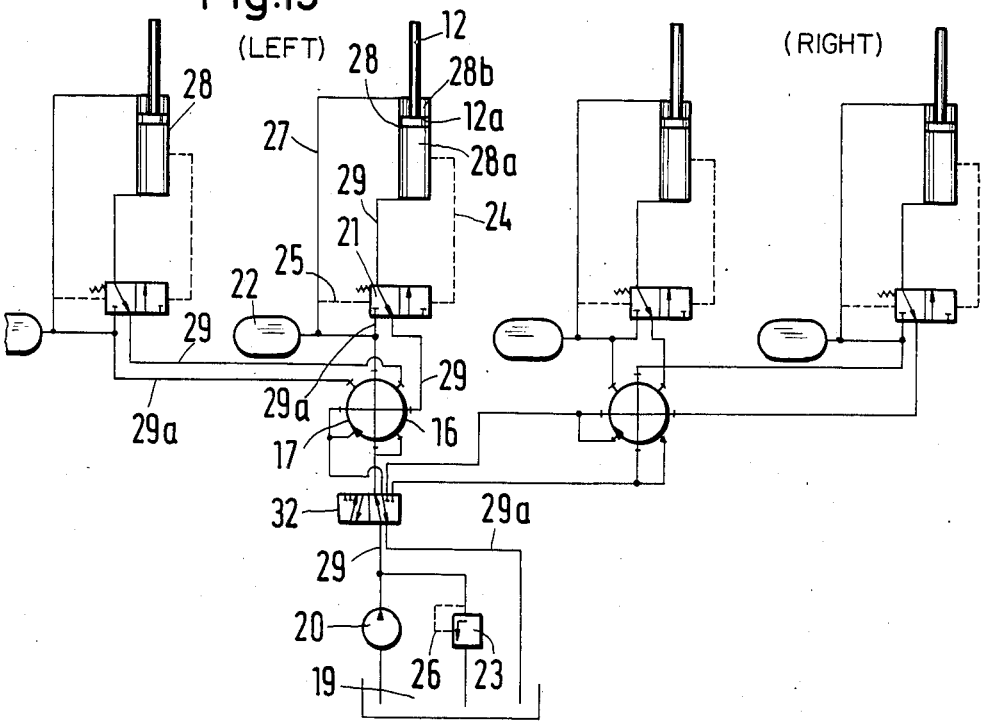
FIG. 13 is a circuit diagram for the pressure supply and feeding arrangement and system.

FIG. 13 illustrates the hydraulic circuit for operating the impact hammers 12 in the cylinders 28. Each of these cylinders can be understood to be a rearward extension of the respective pin holding sleeve 10 guiding the front portion of an impact hammer 12. The hydraulic system is comprised of a tank 19 from which a pump 20 pumps pressure medium through left/right controller 32 to one or the other of the pressure chambers 16 of rotor 17. A valve 23 with a control line 26 serves as overload protection, i.e. eliminates any undesired excess pressure. Pressure oil conduits 29 lead from the pressure chambers 16 to switch valves 21 of the cylinder 28 and to the respectively associated pressure stores 22, which permits oscillation in the system.

The pressure oil flows from the actuated pressure chambers 16 respectively through the conduit 27 being connected to the control line 25, and the connection runs from there into the annular front chamber 28*b* of the cylinder 28. Pressure in chamber 28*b* shifts piston 12*a* of the impact hammer 12 to the rear so that the piston passes the point of connection of the control line 24 into the pressure chamber 28 of the cylinders. As the piston passes the connecting point of the control line 24 the valve 21 changes position by operation of the pressure in the control line 24 and the valves 21 will assume the illustrated position. The pressure medium flow will there upon pass through the direct control line 29 into the rear pressure chamber 28*a* of the cylinder 28, to advance the piston 12*a* which permits the hammer 12 to be propelled against the impact blade and cutter carrying pin 9.

During that advance of piston and hammer the connecting point of the control line 24 is interrupted by the piston 12*a* of the impact hammer 12 for a short period of time. This interruption in turn causes a pressure drop of short duration to occur in the control line 24, and that in turn leads to another actuation of the switch valve 21 so that the cycle begins again. A conduit 29*a* runs from the chambers 16 through the left right control block 32 into the tank 19 and serves as a return path.

Figure 3:
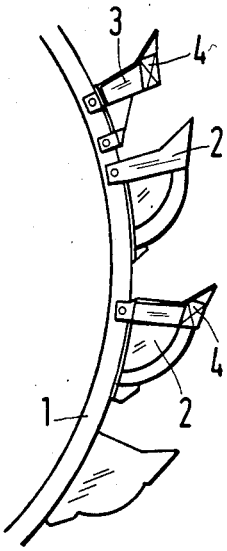
FIG. 3 shows a section of a similar scoop wheel but showing a supplemental feature.

The particularly illustrated components of FIG. 13, of the left/right system 12, 12*a*, 28*a*, *b*, 21, 27, 24 all pertain to one side of the left/right system. For each scoop, there is another, similar system for the cutter in the respective other corner, and selection is made by the particular position of the left/right control device 32. As illustrated in FIG. 13 that device 32 causes the pressure medium from the pump 20 to run to the illustrated cylinders 28, which are for example in this instance all arranged on the left hand side of the scoops. The cylinders illustrated in FIG. 3 and indicated as being right hand cylinders are therefore not connected to the pressure system at all. Also, only those cylinders are depicted in FIG. 13 which are actually in the range corresponding to angle a (FIG. 1) of the scoop wheel. This of course changes progressively as the wheel rotates. On the other hand, the left/right controller 32 changes position, when the pivot motion of the scoop wheel about a vertical axis changes direction (opposite to arrow b in FIG. 2) and that in turn causes the parallel system for right hand impact hammer and cutter blade actuation.

In the case of electric control of the hammers (FIG. 8, 9) the front end of the scoop wheel may carry a position indicating positioner which furnishes a voltage that is proportioned to the rotational angle of the scoop wheel. This then is used as azimuth indication for the wheel to establish the respective azimuthal selection of impact hammer actuation. The voltage is of course a periodic one (saw tooth) as the wheel rotates. The left/-right control is as simple as in the case of hydraulic control because it merely requires some response to movement in one (b) or the opposite direction.

Through control of the throughput and/or control of the oil pressure the impact frequency by the hammers 12 can be matched individually to optimize that operating frequency with respect to the type of material ty be cut and loosened. Through simple plug-in tools it is very easy to change that frequency so as to have available a high degree of flexibility of the system with regard to matching the operating frequency to the type of material encountered, which of course may vary all the time.

The invention is not limited to the embodiments described above, but all changes and modifications thereof, not constituting departures from the he spirit and scope of the invention are intended to be included.

We claim:

1. A scoop wheel of a power shovel having a plurality of scoops arranged along the periphery of the wheel, each scoop having a front cutting edge, said wheel being mounted on a horizontally and vertically moveable boom, the improvement comprising, impact cutter blades arranged in two front corners only of the cutting edge on each scoop; and means for imparting an oscillation upon the cutter blades, the oscillation to occur also in the direction of cutting.

2. The improvement as in claim 1, and including in addition precutters arranged ahead of the scoops, the precutters likewise provided with oscillating impact cutter blades.

3. The improvement as in claim 2, said precutters being connected to the wheel by means of attenuating elements.

4. The improvement as in claim 1, said scoops being affixed to the wheel by means of attenuating elements.

5. The improvement as in claim 1, further including blade carrier means including sleeve means, said impact cutters being provided with pins projecting into the sleeve means, to thereby mount the impact cutters in axial slideable relationship to the carriers;

impact hammer means arranged in the sleeve means for oscillatorily impacting against said respective pins, to thereby cause said blades to vibrate; and means for preventing said pins from rotating in said sleeve means.

6. The improvement as in claim 5, and including energizing means for operating said hammers.

7. The improvement as in claim 6, said energezing means being a hydraulic system including means for intermittently applying hydraulic pressure to said hammers.

8. The improvement as in claim 6, said energizing means being electrical motor means provided for imparting oscillatory motion upon said pins.

9. The improvement as in claim 1, and including means for rendering operation of said impact cutter blades dependent upon a particular angular operating range of said scoop wheel.

10. The improvement as in claim 1, and including means for rendering operation of said impact cutter means dependent upon a horizontal direction of pivoting of said vertically rotating shovel scoop wheel to independently operate right hand and left hand impact cutters on each scoop.

11. The improvement as in claim 1, said scoop wheel being provided with a sleeve like rotor provided with a plurality of radially directed duct means separately connected to the impact cutter blades; and shaft-like stator means including pressure medium distributing chamber means, such that not all radial duct means of the rotor receive pressure fluid when applied to said chamber means, said means for impacting including hydraulic means for intermittently applying pressure from the duct means as connected to the impact cutter blades and thus causing the blades to vibrate.

12. The improvement as in claim 11, wherein said radial duct means are provided in axially spaced pairs, said chamber means in said shaft-like stator means being bi-parted for independently applying pressure medium to the radial ducts of a pair, said scoops, each being provided with two impact blades and two hydraulic actuators, separately operable by pressure fluid through one or the other of the radial bores of a pair.

13. The improvement as in claim 12, and including separately operable hydraulic switch means for controlling the flow of pressurized fluid into one or the other of the two chamber means.

14. The improvement as in claim 1, said means for imparting including electric motor means.

15. The improvement as in claim 14, said means for imparting including groove-and-spring means interposed between the rotary output of the motor means and the cutter blades to convert rotational movement into axial impact movement of the cutter blades.

* * * * *